US007604425B2

(12) United States Patent
Otsuka

(10) Patent No.: US 7,604,425 B2
(45) Date of Patent: Oct. 20, 2009

(54) SHEET PROCESSING APPARATUS

(75) Inventor: Toru Otsuka, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 268 days.

(21) Appl. No.: 11/221,884

(22) Filed: Sep. 9, 2005

(65) Prior Publication Data

US 2006/0283341 A1 Dec. 21, 2006

(30) Foreign Application Priority Data

Jun. 17, 2005 (JP) ..... 2005-178110

(51) Int. Cl.
*B41J 11/00* (2006.01)

(52) U.S. Cl. ..... 400/615.2; 194/206; 209/534; 715/247

(58) Field of Classification Search ..... 400/62, 400/76, 71, 70, 88, 613, 613.1, 615.1, 615.2; 715/243, 244, 246, 247, 788, 808, 841; 194/205, 194/206; 209/534
See application file for complete search history.

(56) References Cited

U.S. PATENT DOCUMENTS

| | | | | |
|---|---|---|---|---|
| 3,786,429 | A * | 1/1974 | Goldman et al. | 400/83 |
| 7,118,297 | B2 * | 10/2006 | Kim | 400/62 |
| 7,318,202 | B2 * | 1/2008 | Sugiyama et al. | 715/788 |
| 2002/0146262 | A1 * | 10/2002 | Inoue | 400/70 |
| 2004/0003980 | A1 | 1/2004 | Hallowell et al. | |
| 2004/0133465 | A1 * | 7/2004 | Koge et al. | 705/14 |
| 2006/0269344 | A1 * | 11/2006 | Zhang et al. | 400/71 |

FOREIGN PATENT DOCUMENTS

| | | |
|---|---|---|
| DE | 297 22 272 | 2/1998 |
| GB | 2 321 549 | 7/1998 |
| JP | 11-105837 | 4/1999 |
| JP | 11-124107 | 5/1999 |
| JP | 2000-099793 | 4/2000 |
| JP | 2003-141606 | 5/2003 |

OTHER PUBLICATIONS

European Search Report dated Dec. 18, 2006 for Appln. No. 05019002.4.
Chinese Office Action dated May 9, 2008 for Application No. 200510104087.8.

* cited by examiner

*Primary Examiner*—Ren Yan
(74) *Attorney, Agent, or Firm*—Pillsbury Winthrop Shaw Pittman, LLP

(57) ABSTRACT

A controller displays a setting screen of printing contents for a paper band used for sealing the preset number of banknotes on a display unit. Various information items to be printed on the paper band are displayed in different colors or information items indicating edge positions when the paper band is wrapped around a preset number of banknotes are displayed in different colors for respective types of banknotes as the layout of information items to be printed on the paper band on the setting screen. Thus, the controller sets the contents to be printed on the paper band in the above display state.

8 Claims, 8 Drawing Sheets

SHEET PROCESSING APPARATUS

CROSS-REFERENCE TO RELATED APPLICATIONS

This application is based upon and claims the benefit of priority from prior Japanese Patent Application No. 2005-178110, filed Jun. 17, 2005, the entire contents of which are incorporated herein by reference.

BACKGROUND OF THE INVENTION

1. Field of the Invention

This invention relates to a sheet processing apparatus which seals a preset number of sheets by using a paper band having preset information printed thereon.

2. Description of the Related Art

Conventionally, in a banknote processing apparatus as a sheet processing apparatus, a paper band is wrapped around a preset number banknotes to seal the same. In such a banknote processing apparatus, for example, a plurality of banknotes are classified according to a condition such as a banknote type or banknote condition. Further, particular banknotes which reach a present number among the thus classified banknotes are wrapped with a paper band on which preset information is printed and are thus sealed. In the banknote processing apparatus, preset various information items are printed on the paper band used to seal the preset number of banknotes. In the conventional banknote processing apparatus, preset printing contents which are previously set or printing contents which are set only by a special operation are printed on the paper band. Therefore, it is difficult to change the printing contents of the paper band in the conventional banknote processing apparatus.

BRIEF SUMMARY OF THE INVENTION

An object of this invention is to provide a sheet processing apparatus in which contents to be printed on a paper band used to seal a preset number of sheets can be easily set according to a user's request.

A sheet processing apparatus which seals sheets for every preset number according to an aspect of this invention comprises a sealing mechanism which wraps a paper band around sheets for every preset number and seals the sheets, a printing mechanism which prints information on the paper band used to seal the sheets by the sealing mechanism, a setting section which sets printing contents to be printed on the paper band by the printing mechanism, and a display section which displays an image on the paper band obtained when the printing contents set by the setting section are printed on the paper band by the printing mechanism.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

There will now be described a preferable embodiment of this invention with reference to the accompanying drawings in detail.

Figure 1:
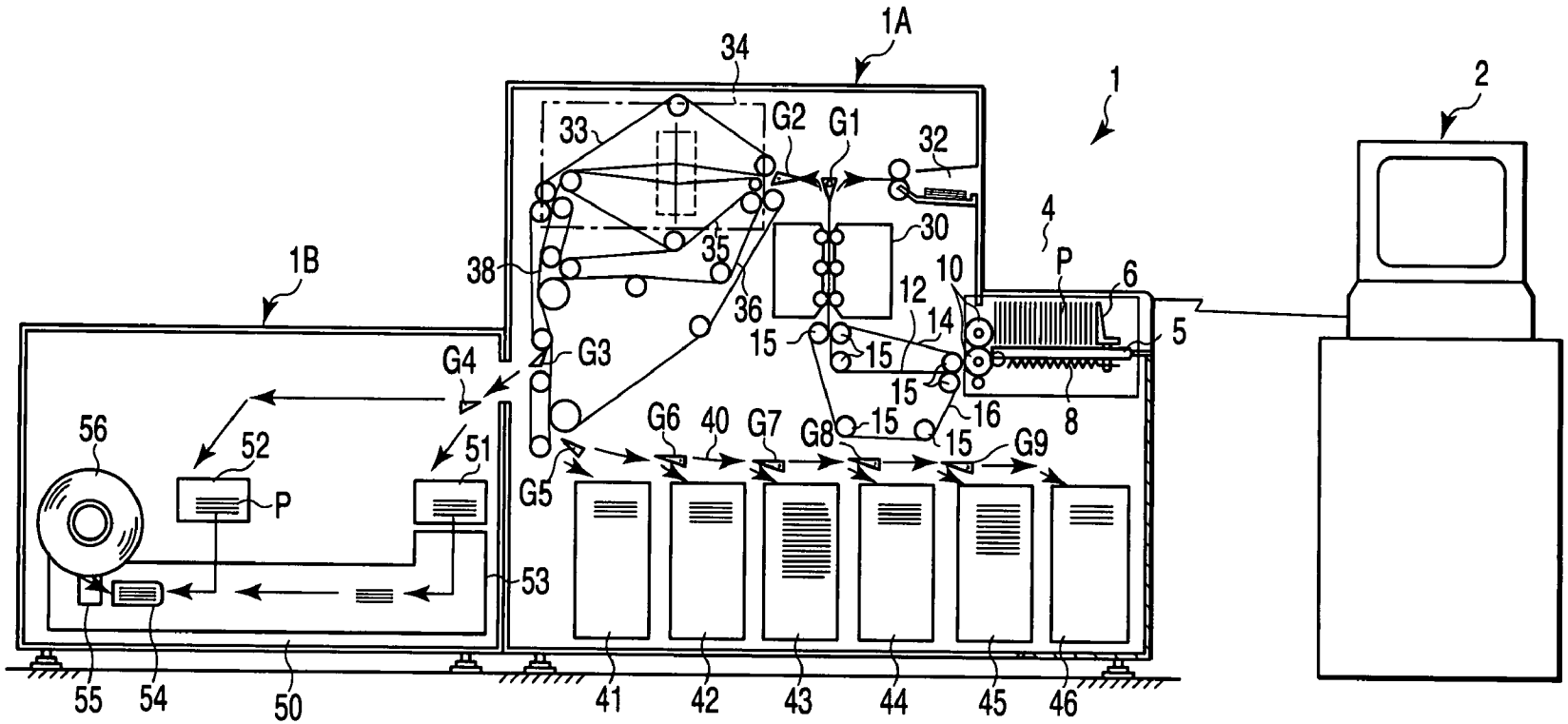
FIG. 1 is a view showing a schematic configuration of a banknote processing system (sheet processing apparatus) according to an embodiment of this invention.

FIG. 1 shows the schematic configuration of a banknote processing system (sheet processing apparatus) according to an embodiment of this invention.

The banknote processing system includes a main body 1 of the banknote processing apparatus and a control device 2 which operates the banknote processing apparatus main body 1. One or a plurality of banknote processing apparatus main bodies 1 controlled by the control device 2 can be provided.

The banknote processing apparatus main body 1 includes a separately storing device 1A and sealing device 1B. The banknote processing apparatus main body 1 is so configured that a desired number of sealing devices 1B can be connected to one separately storing device 1A. The separately storing device 1A separately divides banknotes according to the types or states of banknotes and stores the thus divided banknotes for each banknote type or state. The sealing device 1B performs a sealing process for wrapping a paper band around banknotes for every preset number to form a bundle of banknotes.

A plurality of banknotes of plural types are collectively inserted into the separately storing device 1A. The separately storing device 1A separately divides the inserted banknotes according to the types or states of the banknotes. The separately storing device 1A transfers the thus divided banknotes to respective storage boxes (cassettes) or sealing device 1B. The sealing device 1B stores banknotes supplied from the separately storing device 1A into the storage box 51, 52 and wraps a paper band around the banknotes for every preset number.

The control device 2 performs the operations for controlling the banknote processing apparatus main body 1, setting the operation of the banknote processing apparatus main body 1 or managing processing data by the banknote processing apparatus main body 1. For example, the control device 2 is configured by a personal computer. The control device 2 includes a display unit, operating unit and storage section which will be described later.

Next, the internal configuration of the banknote processing apparatus main body 1 is explained.

As shown in FIG. 1, the banknote processing apparatus main body 1 includes the separately storing device 1A and sealing device 1B.

In the separately storing device 1A, an inserting portion 4 through which a plurality of banknotes P are inserted is provided. A plurality of banknotes of plural types are collectively inserted into the inserting portion 4. The banknotes P inserted into the inserting portion 4 have a lengthwise direction and short-length direction. The banknotes are inserted into the inserting portion 4 while the top end or bottom end of the banknotes in the lengthwise direction is set to face downward.

The inserting portion 4 includes a stage 5, backup plate 6 and takeout roller 10. A plurality of banknotes P are inserted with the top end or bottom end thereof abut against the stage 5. The backup plate 6 is provided in the vertical direction with respect to the stage 5. The backup plate 6 is biased or moved towards the takeout roller 10 (in the left direction in the drawing) along the stage 5 by the action of a spring 8. The takeout roller 10 is configured by a pair of rollers. The takeout roller 10 is rotated in a preset direction to sequentially take out the banknote P which lies on the left end side in the drawing on the stage 5. Therefore, a plurality of banknotes P inserted into the inserting portion 4 are moved in the left direction in the drawing along the stage 5 by the action of the backup plate 6 and pressed against the takeout roller 10 (takeout portion).

In the succeeding stage of the takeout roller 10, a feeding path 12 is provided. The feeding path 12 includes a plurality of rollers 15 and conveyor belts 14, 16. The banknote P is fed along the feeding path 12 by use of the conveyor belts 14, 16 driven by the plurality of rollers 15. On the feeding path 12, banknotes P which are taken out by the takeout roller 10 are sequentially supplied. For example, the takeout roller 10 supplies the banknote P to the feeding path 12 in the short-length direction with the top end or bottom end set at the front. In this case, the front and back surfaces of the banknotes P supplied onto the feeding path 12 by the takeout roller 10 are variously set. In the example of the configuration shown in FIG. 1, the takeout direction of the banknote P taken out from the inserting portion 4 is set to face downward.

A detecting section 30 is provided on the feeding path 12 formed to extend in the succeeding stage of the takeout roller 10. The detecting section 30 detects the features such as the presence or absence of stains or damages, the top or bottom side, the front or back surface and the type of a banknote P. The detecting section 30 includes various sensors. The various sensors of the detecting section 30 read various information items from the banknote P fed along the feeding path 12. In the detecting section 30, for example, an image sensor which reads an image on the front surface of the banknote P, a sensor which detects the thickness of the banknote P, a sensor which detects the magnetic material contained in the banknote P and the like are provided. A determining section which will be described later determines the above features of the banknote P based on information read by the various sensors of the detecting section 30.

In the separately storing device 1A shown in FIG. 1, a plurality of banknotes P are inserted into the inserting portion 4 while the front and back surfaces and the top and bottom sides of the banknotes are variously set. Therefore, the front and back surfaces and the top and bottom sides of the banknotes P which pass through the detecting section 30 are also variously set. In this case, four types of directions relating to the front or back surface and the top or bottom side of the banknotes which pass through the detecting section 30 are provided. In the following explanation, a banknote P taken out with the front surface set to face upward and the top end set in the forward direction of the feeding direction is referred to as a front-top (FF) bill and a banknote P taken out with the front surface set to face upward and the bottom end set in the forward direction of the feeding direction is referred to as a front-bottom (FR) bill. Further, a banknote P taken out with the back surface set to face upward and the top end set in the forward direction of the feeding direction is referred to as a back-top (BF) bill and a banknote P taken out with the back surface set to face upward and the bottom end set in the forward direction of the feeding direction is referred to as a back-bottom (BR) bill. That is, the banknote which passes through the detecting section 30 is fed while it is being set in one of the four types of feeding states.

A plurality of gates G1 to G9 which selectively switch the feeding direction of the banknote P based on the detection result in the detecting section 30 are provided on the feeding path 12 formed to extend in the succeeding stage of the detecting section 30.

First, the gate G1 distributes the banknotes P into banknotes which can be processed by the succeeding stage and banknotes to be rejected. For example, in the detecting section 30, a banknote which is determined impossible to be subjected to the succeeding-stage process is fed to a reject box 32 (in the right direction in the drawing) via the gate G1. For example, as a banknote which is determined impossible to be subjected to the succeeding-stage process, a banknote which is determined to be one of two banknotes which are taken out at the same time, a banknote which is determined to skew to a large extent exceeding a preset level, a banknote (which is not limited to a banknote) such as a forged banknote or damaged banknote determined not to be a formal banknote which can be used for re-circulation and the like are provided. Access can be made to the reject box 32 from the exterior of the sheet processing apparatus 1. That is, the banknotes P accumulated in the reject box 32 can be taken out by a person in charge.

A banknote P which is determined possible to be subjected to the succeeding-stage process in the detecting section 30 is fed to the gate G2 (in the left direction in the drawing) via the gate G1. The gate G2 distributes the banknotes P according to the front or back surfaces. The feeding path on the downstream side from the gate G2 is divided or branched into two paths. That is, the gate G2 selectively switches the feeding direction of the banknote P into one of two feeding directions according to the front and back surfaces.

On one of the feeding path divided on the downstream side from the gate G2, a front-back surface reversing mechanism 34 (front-back surface reversing section) which reverses the front-back surface of the banknote P is provided. The other feeding path 36 divided on the downstream side from the gate G2 is used as a conveyor pass which simply permits the banknote P to pass therethrough without reversing the front-back surface of the banknote P. That is, in the succeeding stage of the gate G2, the front-back surfaces of the banknotes P are uniformly arranged.

The front-back surface reversing mechanism 34 is configured by two sets of conveyor belts 33, 35. The conveyor belts 33, 35 configure a twisted feeding path which is rotated by 180° around the central axis from the inlet port towards the outlet port. Therefore, the front or back surfaces of the banknote P distributed to the front-back surface reversing mechanism 34 by the gate G2 are reversed. For example, the front or back surface of an FF bill is reversed by the front-back surface reversing mechanism 34 and the FF bill is converted into a BF bill with the back surface set to face upward.

A banknote P which has passed through the front-back surface reversing mechanism 34 so that the front or back surface thereof is reversed and a banknote P which has passed through the feeding path (feeding pass) 36 without passing through the front-back surface reversing mechanism 34 are fed to the gate G3 via a combining section 38.

Further, the processing time (feeding time) for the banknote P to reach the combining section 38 via the front-back surface reversing mechanism 34 from the gate G2 is set equal to the feeding time for the banknote P to reach the combining section 38 via the feeding path 36 from the gate G2. As a result, the banknote P which is fed through the front-back surface reversing mechanism 34 and the banknote P which passes through the feeding path 36 pass through the combining section 38 at the same timing.

The gate G3 distributes the banknotes P which have passed through the combining section 38. The feeding path on the downstream side from the gate G3 is divided into two paths. The gate G3 selectively switches the feeding direction of the banknote P into one of the two paths according to the type (or state) of the banknote P.

One of the feeding paths divided on the downstream side from the gate G3 is a feeding path which feeds the banknote P to the sealing device 1B. Further, the other feeding path (horizontal feeding path) 40 divided on the downstream side from the gate G3 is a feeding path which stores the banknotes P into storage boxes 41 to 46 of the separately storing device 1A. Further, sensors which detect the presence or absence of banknotes are provided in the storage boxes 41 to 46.

That is, the horizontal feeding path 40 divided in the right direction in the drawing by the gate G3 forms a feeding path which extends in substantially the horizontal direction above the plurality of storage boxes 41 to 46. The five gates G5 to G9 which separately distribute the banknotes P into one of the six storage boxes 41 to 46 are provided on the horizontal feeding path 40.

The banknote P which is selectively distributed by the gate G5 lying on the uppermost side of the horizontal feeding path 40 is stored in the storage box 41. The banknote P which is selectively distributed by the gate G6 is stored in the storage box 42. The banknote P which is selectively distributed by the gate G7 is stored in the storage box 43. The banknote P which is selectively distributed by the gate G8 is stored in the storage box 44. The banknote P which is selectively distributed by the gate G9 is stored in the storage box 45 or 46.

As shown in FIG. 1, the sealing device 1B includes a storage box (first storage box) 51, storage box (second storage box) 52, supplying section 53, sealing mechanism 54, printing mechanism 55 and band supplying section 56. The storage boxes 51, 52 store banknotes fed via the gate G4. In the storage boxes 51, 52, sensors which detect the presence or absence of banknotes are provided.

The supplying section 53 supplies banknotes P of a preset number (for example, 100 sheets) stored in the storage box 51 or 52 to the sealing mechanism 54. The sealing mechanism 54 is a sealing mechanism which wraps (seals) a paper band (sealing band) S around a preset number (for example, 100 sheets) of banknotes P supplied from the supplying section 53 and stored in the storage box 51 or 52.

The printing mechanism 55 prints printing contents based on a preset format on the paper band S used to seal the preset number of banknotes P in the sealing mechanism 54. Information and format printed on the paper band S by the printing mechanism 55 are set on a paper band print setting screen to be described later. The band supplying section 56 supplies the paper band S on which preset information is printed by the printing mechanism 55 to the sealing mechanism 54. Thus, in the sealing mechanism 54, a preset number of banknotes are sealed by use of the paper band S having preset information printed thereon by the printing mechanism.

Figure 2:
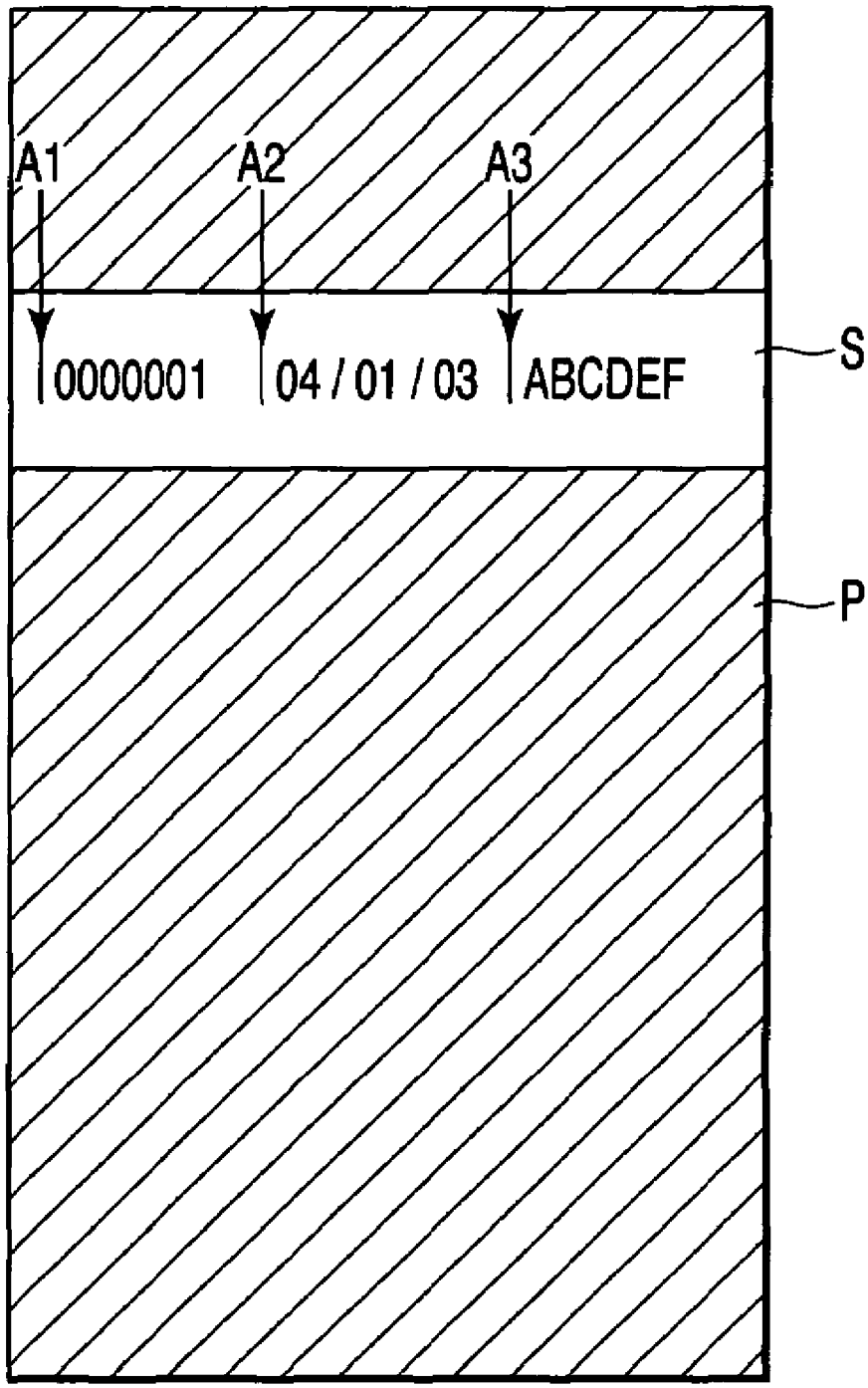
FIG. 2 is view showing a bundle of banknotes sealed by use of a paper band having information printed thereon.

For example, FIG. 2 shows a bundle of banknotes sealed by use of the paper band S. In an example shown in FIG. 2, as various information items, sequence information "0000001", date information "04/01/03", operator information "ABC-DEF" and the like are printed on the paper band S by the printing mechanism 55. The above information items are printed on the paper band based on a position (print starting positions A1, A2, A3) set in the paper band print setting process to be described later.

A banknote P is supplied to the sealing device 1B via the feeding path branched in the left direction in the drawing by the gate G3 of the separately storing device 1A. The feeding direction of the banknote P supplied from the separately storing device 1A is selectively switched to one of the two directions by the gate G3 in the sealing device 1B. The banknote P selectively fed via the branched feeding path by the gate G4 is selectively stored in one of the storage boxes 51 and 52 in the sealing device 1B.

The banknote P stored in one of the storage boxes 51 and 52 via the gate G4 is fed into the sealing mechanism 54 by the supplying section 53. The band supplying section 56 supplies a paper band S having preset information printed thereon by the printing mechanism 55 to the sealing mechanism 54. As a result, the sealing mechanism 54 seals a preset number of banknotes P supplied from the supplying section 53 by use of a paper band S supplied from the band supplying section 56. A bundle of the banknotes P sealed by the paper band S for every preset number is fed out to the exterior of the device via a conveyor (not shown).

In the separately storing device 1A, a particular type of bill is supplied to the sealing device 1B based on setting contents to be described later. Therefore, in the sealing device 1B, banknotes of a particular type supplied in the separately storing device 1A are sealed by use of a paper band S. Further, banknotes P of a type other than the particular type to be sealed in the sealing device 1B are stored in one of the storage boxes 41 to 46 in the separately storing device 1A.

Next, the control system of the sheet processing system is explained.

Figure 3:
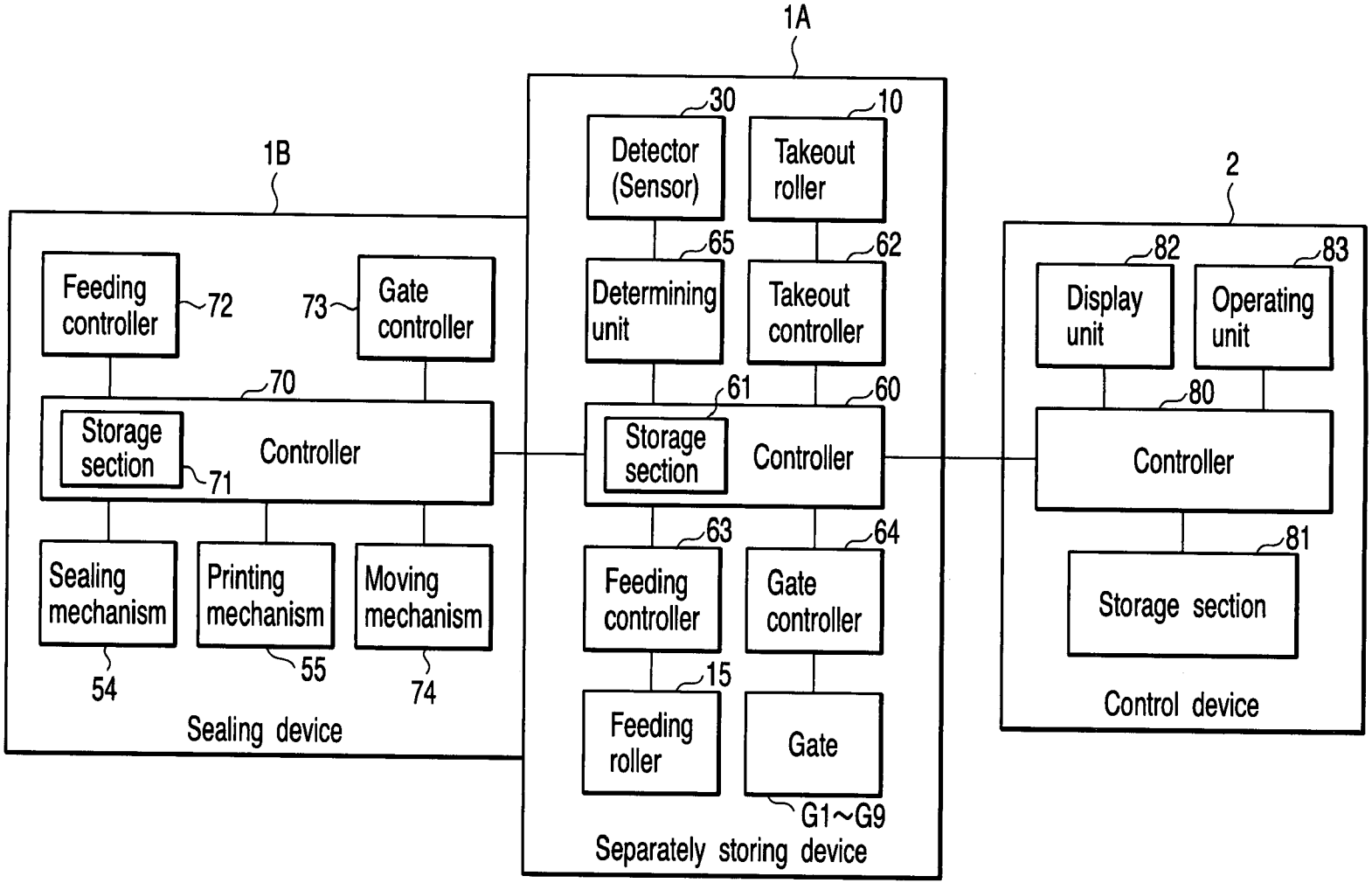
FIG. 3 is a block diagram showing a control system of the banknote processing system.

FIG. 3 is a block diagram showing the control system of the banknote processing system.

As shown in FIG. 3, the control system of the separately storing device 1A of the banknote processing apparatus main body 1 includes a controller 60, storage section 61, takeout controller 62, feeding controller 63, gate controller 64 and determining unit 65.

The controller 60 controls the operation of the whole portions of the separately storing device 1A according to a preset operation program. In the storage section 61, an operation program executed by the controller 60 is stored. Further, the storage section 61 is used for storing data. For example, in the storage section 61, a counter table which counts the number of sheets stored in the storage boxes 41 to 46 and the storage boxes 51, 52 of the sealing device 1B is provided.

The takeout controller 62 drives the takeout roller 10 based on the control operation of the controller 60. The feeding controller 63 drives the feeding rollers 15, . . . based on the control operation of the controller 60. The gate controller 64 drives the gates G1 to G3 and G5 to G9 based on the control operation of the controller 60.

The determining unit 65 determines the state of the banknote P based on the result of detection by the detecting section 30. In the determining unit 65, the feature of the banknote P is determined by comparing information read by the respective sensors with reference information. Further, the determining unit 65 outputs the result of determination based on the result of detection by the detecting section 30 to the controller 60.

For example, the determining unit 65 determines the type of the banknote P and determines the front or back surface and the top or bottom side of the banknote P. Further, the determining unit 65 determines that the banknote P is a formal bill or damaged bill. In this case, the formal bill means a bill which can be re-circulated and the damaged bill means a bill which cannot be re-circulated. That is, whether the banknote is a formal bill or damaged bill is determined according to whether the state (quality) of the banknote P is good or bad. The determining unit 65 determines that the banknote P is a formal bill or damaged bill according to the degrees of stains, breakage, folds, paper quality or attached tapes of the banknote.

As shown in FIG. 3, the control system of the sealing device 1B of the banknote processing apparatus main body 1 includes a controller 70, storage section 71, feeding controller 72, gate controller 73, moving mechanism 74, sealing mechanism 54, printing mechanism 55 and the like.

The controller 70 controls the operation of the whole portions of the sealing device 1B according to a preset operation program. In the storage section 71, an operation program executed by the controller 70 is stored. The feeding controller 72 drives the feeding roller based on the control operation of the controller 70. The gate controller 73 drives the gate G4 based on the control operation of the controller 70. The moving mechanism 74 moves (feeds) a preset number of sheets stored in the storage box 51 or 52 based on the control operation of the controller 70.

As shown in FIG. 3, the control system of the control device 2 includes a controller 80, storage section 81, display unit 82, operating unit 83 and the like.

The controller 80 controls the operation of the whole portions of the control device 2 according to a preset operation program. For example, the controller 80 has a function of making various operation settings for the separately storing device 1A based on an operation instruction from a person in charge. In the storage section 81, an operation program executed by the controller 80 is stored. In the storage section 81, setting information for the storage boxes 51, 52 of the sealing device 1B and the storage boxes 41 to 46 of the separately storing device 1A are stored in correspondence to preset contents (setting names) which will be described later.

The display unit 82 displays operation guidance for a person in charge based on the display control operation by the controller 80. The operating unit 83 is operated by the person in charge to input an operation instruction. The display unit 82 is configured by a display device, for example. The operating unit 83 is configured by an input device such as a keyboard or mouse. For example, the display unit 82 and operating unit 83 can be configured by a display device containing a touch panel. Further, the display unit 82 and operating unit 83 can be configured by a display device containing a touch panel and an input device such as a keyboard.

Next, a setting process (paper band print setting process) of printing contents for the paper band of the sealing device 1B by the control device 2 is explained.

In this example, it is assumed that the display unit 82 and operating unit 83 are configured by a display device containing a touch panel. Further, it is assumed that paper band print setting operation is performed by a manager (supervisor).

Figure 4:
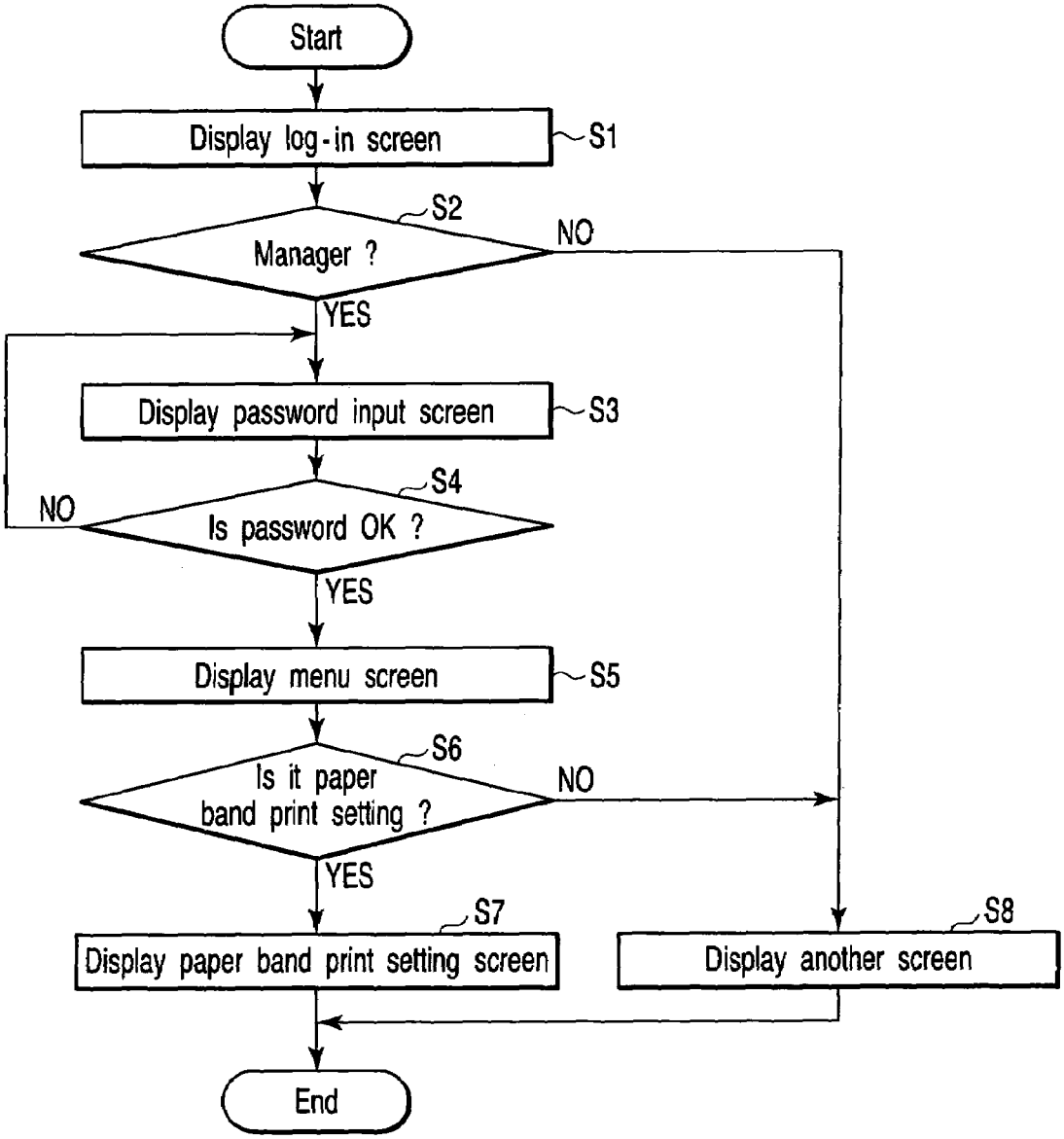
FIG. 4 is a flowchart for illustrating the operation of displaying cassette setting screen in a control device.
Figure 5:
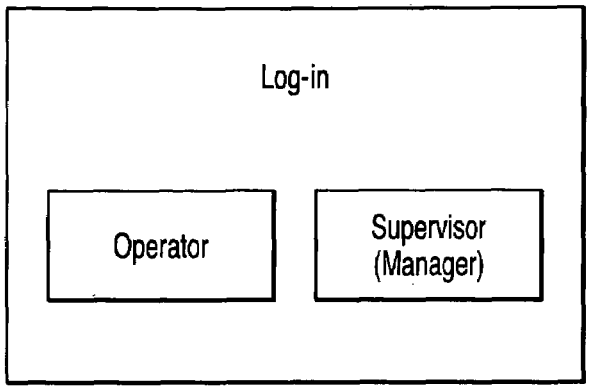
FIG. 5 is a view showing one display example of a log-in screen.
Figure 6:
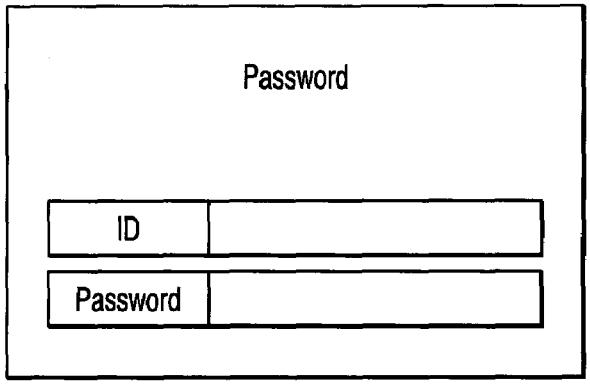
FIG. 6 is a view showing one display example of a manager authentication screen.
Figure 7:
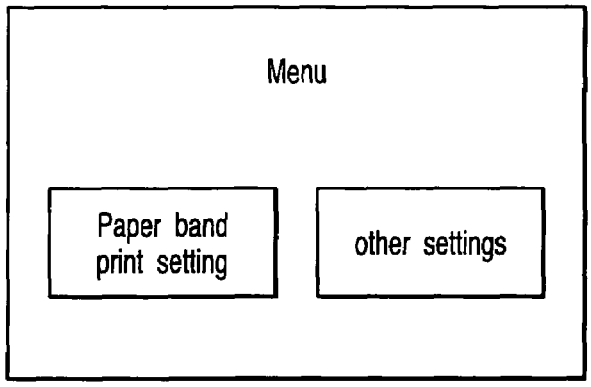
FIG. 7 is a view showing one display example of a menu screen for the manager.

FIG. 4 is a flowchart for illustrating the operation of displaying a paper band print setting screen in the control device 2. Further, FIG. 5 is a view showing one display example of a log-in screen. FIG. 6 is a view showing one display example of a manager authentication screen. FIG. 7 is a view showing one display example of a menu screen for the manager.

First, the controller 80 displays a log-in screen on the display unit 82 (step S1). For example, as shown in FIG. 5, selection buttons for a supervisor (a manager having authority for changing the settings or the like) and an operator (a person in charge having no management authority) are displayed on the log-in screen. If the button which selects the manager is input on the log-in screen ("YES" in the step S2), the controller 80 displays a manager authentication screen on the display unit 82 (step S3). For example, as shown in FIG. 6, the manager authentication screen displays ID information for the manager and a password on the input screen.

If authentication information (ID information and password) is input on the screen, the controller 80 determines whether the input authentication information is correct or not (step S4). When it is determined in the above determination process that the input authentication information is correct ("YES" in the step S4), the controller 80 displays a menu screen for the manager on the display unit 82 (step S5).

For example, as shown in FIG. 7, a button which selects a setting (paper band print setting) of the printing contents for at least a paper band is displayed on the menu screen for the manager. If the button which selects the paper band print setting is input on the menu screen for the manager ("YES" in the step S6), the controller 80 displays a paper band print setting screen which will be described later on the display unit 82 (step S7). On the paper band print setting screen, a format and information to be printed on the paper band by the printing mechanism of the sealing mechanism 1B are set.

As described above, the paper band print setting operation can be performed only by the manager authenticated by the authentication information such as a password. That is, in the banknote processing system, the printing contents for a paper band used to seal banknotes are set based on the setting contents set by the manager. Thus, it becomes possible to prevent a general operator (a person in charge having no management authority) from changing the printing contents for the paper band used to seal banknotes.

Next, a process of setting the printing contents for a paper band S is explained.

Figure 8:
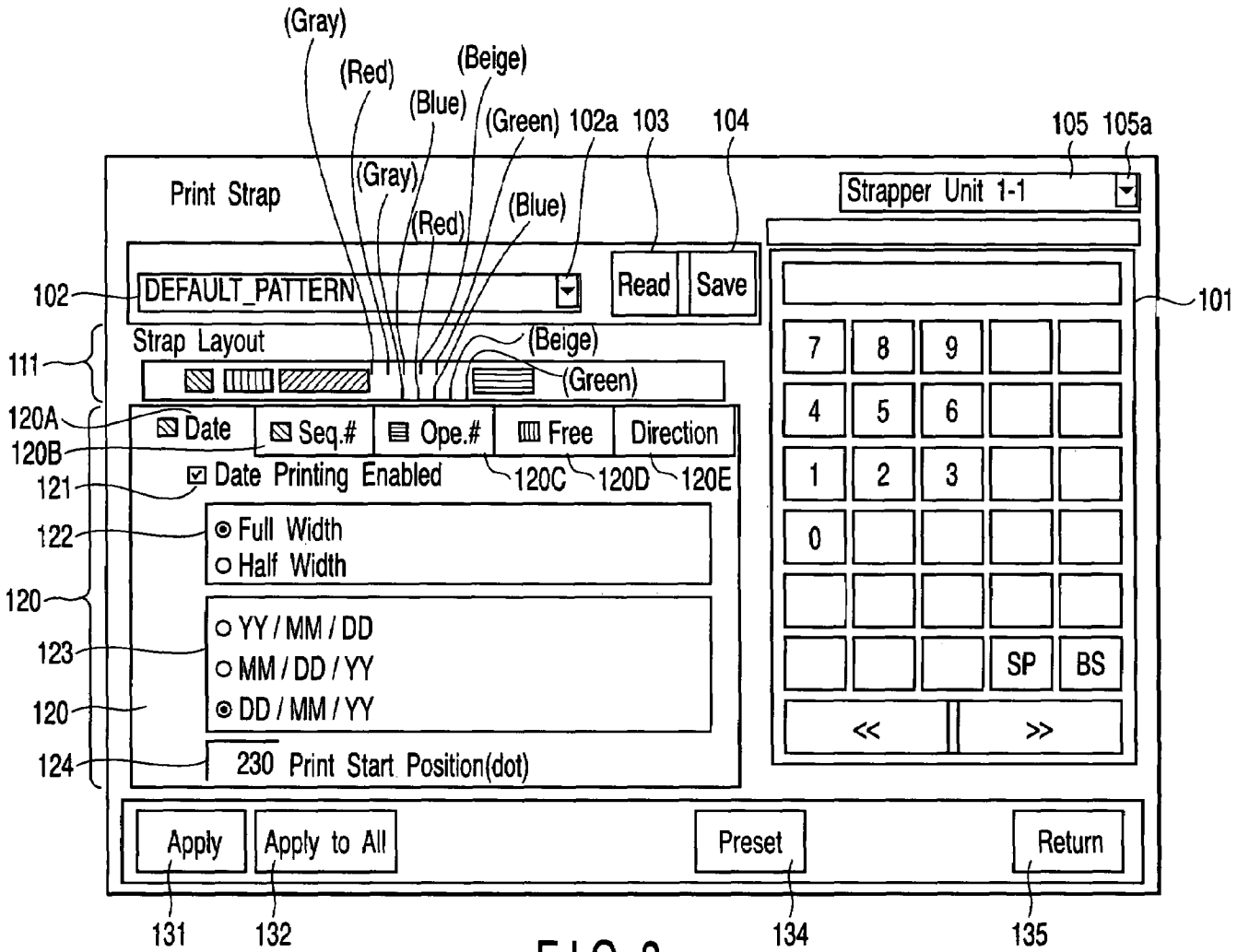
FIG. 8 is a view showing one display example of a paper band print setting screen.

FIG. 8 shows one display example of the paper band print setting screen.

As shown in FIG. 8, the paper band print setting screen is configured by an information input button 101, setting name display window 102, read button 103, save button 104, unit display window 105, layout display portion (layout image) 111, print data setting portion 120, date print specifying button 121, character type specifying button 122, date format specifying button 123, date print starting position 124, application button 131, application-to-all button 132, preset button 134, return button 135 and the like.

Figures 9A, 9B, 9C:
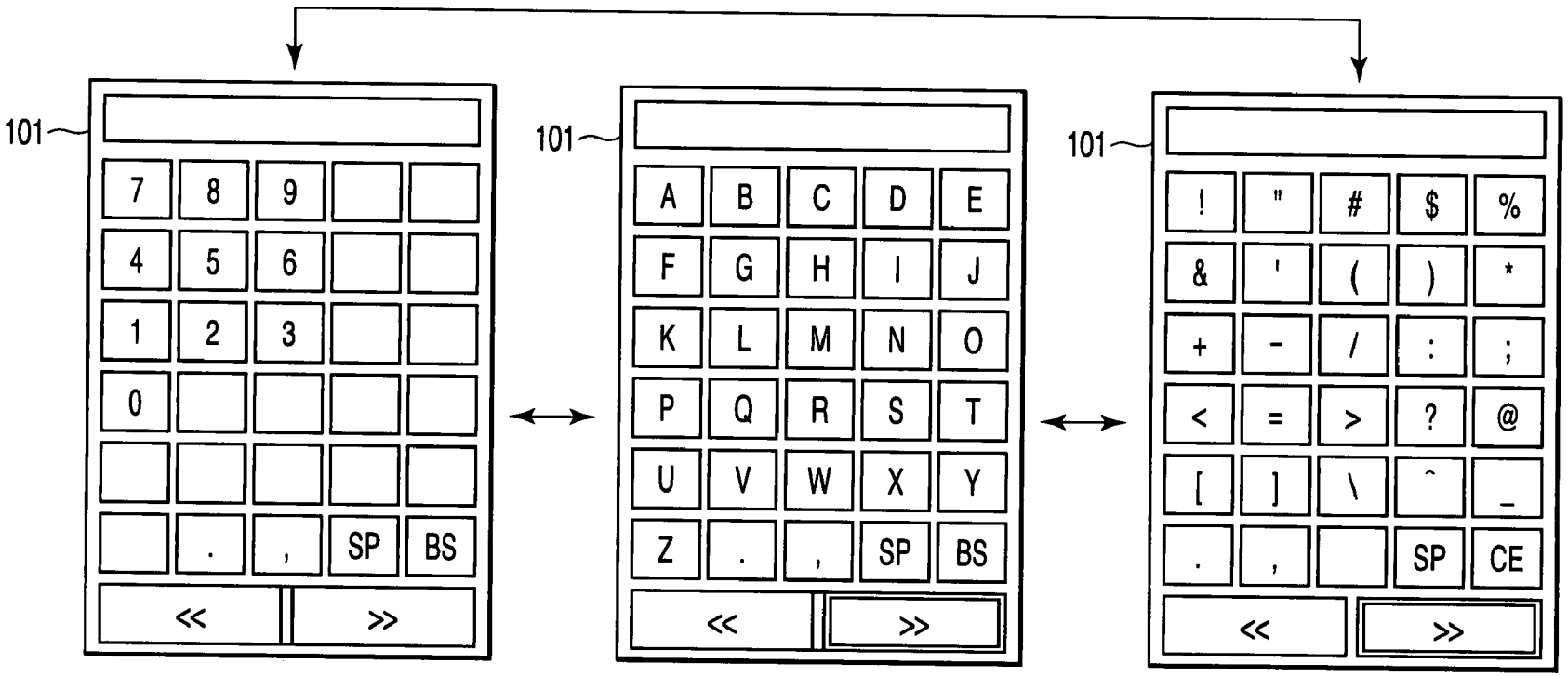
FIG. 9A is a view showing one display example of a ten-key pad used as information input buttons to input numerals.
FIG. 9B is a view showing one display example of alphabet keys used as information input buttons to input characters.
FIG. 9C is a view showing one display example of symbol keys used as information input buttons to input various symbols.

The information input button 101 includes various buttons which are operated to input information. The information input button 101 is configured by input enable buttons of a touch panel. As the information input button 101, buttons which input numerals, characters, symbols and the like are displayed, for example. FIGS. 9A, 9B, 9C are views showing display examples of the information input button 101. In FIG. 9A, a ten-key pad which inputs numerals is displayed as the information input button 101. In FIG. 9B, alphabet buttons which input characters are displayed as the information input button 101. In FIG. 9C, list-of-symbols buttons which input various symbols are displayed as the information input button 101. The display screens of FIGS. 9A, 9B and 9C can be switched by selectively operating cursor keys ("<<" key and ">>" key) displayed on the lower end portion of each display screen.

The display window 102 is a display area which displays a setting name attached at each paper band print setting name. As shown in FIG. 8, in the display window 102, a setting name corresponding to the setting contents displayed on the screen is displayed. The setting name displayed on the display window 102 can be changed by clicking a button 102*a* on the right end side of the display window 102, for example.

The read button 103 is a button which specifies reading of the setting contents of the setting name displayed on the display window 102. The save button 104 is a button which specifies storage of the setting contents displayed on the setting screen shown in FIG. 8 by use of the setting name displayed on the display window 102.

The unit display window 105 is an area which displays information indicating a unit which seals banknotes by use of a set paper band. For example, in the display example of FIG. 8, "Strapper Unit 1-1" displayed on the unit display window 105 indicates a first storage section (storage section 51 of the sealing device 1B in the configuration example of FIG. 1) of the first sealing section.

In the system of this embodiment, a plurality of sealing devices are connected in some cases. Therefore, in the unit display window 105, information indicating the sealing device and the storage section in the sealing device is displayed. Further, in the sealing device 1B shown in FIG. 1, it is possible to assign each storage box 51, 52 one type of banknotes. Therefore, the unit name displayed on the unit display window 105 also has a function of indicating the corresponding type of banknotes.

Further, in the unit display window 105, the type of banknotes to be sealed can be displayed or the unit name and the type of banknotes to be sealed by use of the unit can be displayed. The unit displayed on the unit display window 105, that is, the unit to be set can be changed by clicking a button 105*a* on the right end side of the unit display window 105.

The layout display portion 111 indicates the layout of information to be printed on a paper band. On the layout display portion 111, an image of the contents to be printed on the paper band is displayed.

In the layout display portion 111, various information items to be printed on the paper band are displayed with different colors. The colors displayed in the layout display portion 111 and the types of information items corresponding to the colors indicate the relation between information items and corresponding colors in the print data setting portion 120 which will be described later.

Further, in the layout display portion 111, an overlapping area between printing areas (a plurality of printing areas) of different types of information items is displayed by use of a preset color. For example, the overlapping area is displayed in red. Information to be printed on the paper band is information such as characters.

Further, in the layout display portion 111, the edge positions of the paper bands in the sealed state (in a state in which each of the paper band is wrapped around a preset number of banknotes) are displayed in different colors for respective bill types. When the sizes or thicknesses of banknotes are different for respective bill types, the edge positions of the paper bands are different for respective bill types even if the number of banknotes is the same. Therefore, in the layout display portion 111, the edge positions of the paper bands are displayed in different colors for respective bill types. In the example of FIG. 8, the display example of the edge positions of paper bands when Euro banknotes are used is shown. The Euro banknotes are classified according to colors for respective bill types. Thus, the edge positions of the paper bands for respective bill types are displayed by use of colors of the respective bill types.

The print data setting portion 120 performs the operation of setting various information items to be printed. The print data setting portion 120 includes a data print setting button 120A, sequence print setting button 120B, operator print setting button 120C, free print setting button 120D, option setting button 120E and the like. The above buttons 120A, 120B, 120C, 120D and 120E are buttons which specify the types of information items to be set.

For example, if the data print setting button 120A is touched, a screen used to set the contents (format, type of characters, print start position and the like) of a date to be printed on a paper band is displayed in the print data setting portion 120 as shown in FIG. 8.

If the sequence print setting button 120B is touched, a screen used to set the contents (format, type of characters, print start position and the like) of sequence information to be printed on a paper band is displayed in the print data setting portion 120.

If the operator print setting button 120C is touched, a screen used to set the contents (format, type of characters, print start position and the like) of operator information to be printed on a paper band is displayed in the print data setting portion 120.

Further, if the free print setting button 120D is touched, a screen used to set the contents (format, type of characters, print start position and the like) of information (information printed according to the setting by the user) to be freely printed on a paper band is displayed in the print data setting portion 120.

If the option setting button 120E is touched, a screen used to set options for printing contents is displayed in the print data setting portion 120. For example, in the option setting button 120E, the direction (the direction of characters) of printing on a paper band is set.

The display example of the print data setting portion 120 shown in FIG. 8 shows a case wherein the data print setting button 120A is touched. That is, if the data print setting button 120A is touched, the date print specifying button 121, character type specifying button 122, date format specifying button 123, date print starting position setting portion 124 and the like are displayed in the print data setting portion 120.

The date print specifying button 121 is a button which specifies whether a date is printed on the paper band or not. When the data is printed on the paper band, the date print specifying button 121 is set into a state in which a mark is displayed in the check box as shown in FIG. 8. The character type specifying button 122 is a button which specifies a type of characters to be printed as the date. When the date is printed on the paper band with full-width characters, the character type specifying button 122 is set into a state in which a mark is displayed in a check box corresponding to "Full Width" as shown in FIG. 8.

The date format specifying button 123 is a button which specifies a format of a date to be printed on the paper band.

When the date is printed on the paper band as "Date/Month/Year", the date format specifying button 123 is set into a state in which a mark is displayed in a check box corresponding to "DD/MM/YY" as shown in FIG. 8. The date print starting position setting portion 124 indicates a display column which specifies a print start position of a date to be printed on the paper band.

Further, the application button 131 is a button which is specified when the setting contents set on the setting screen are applied to a selected paper band. The application-to-all button 132 is a button which is specified when the contents set on the setting screen are applied to all of the paper bands. The preset button 134 is a button which is specified to set a setting name. The return button 135 is a button which specifies that the operation is returned to the first step.

Next, the display contents of the layout display portion 111 described above are explained in detail.

Figure 10:
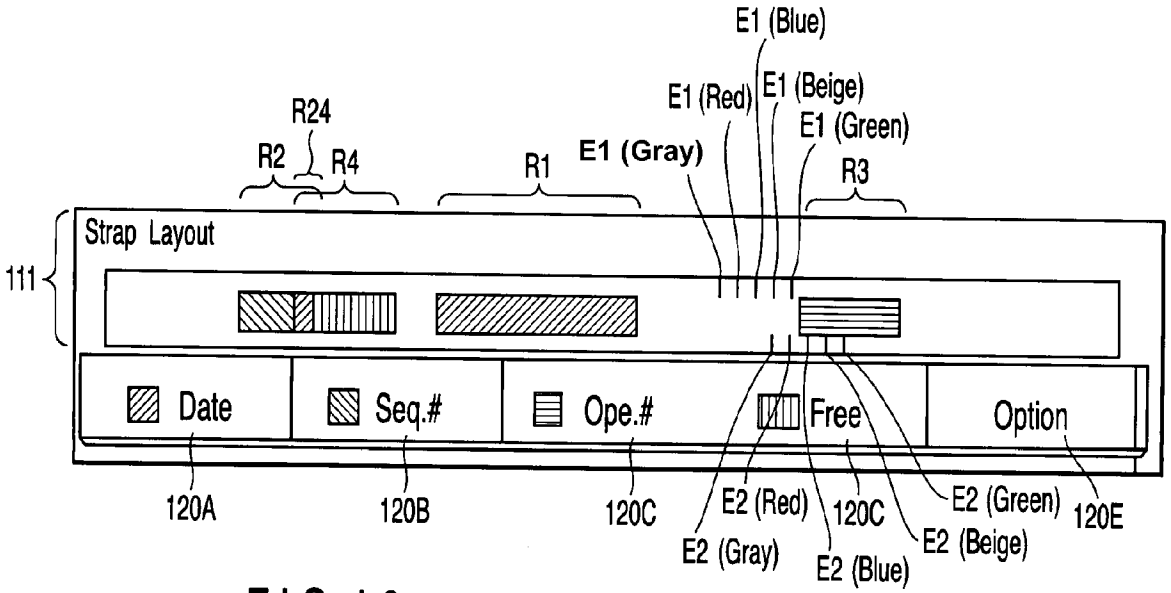
FIG. 10 is a view showing one display example of a layout display portion.
Figure 11:
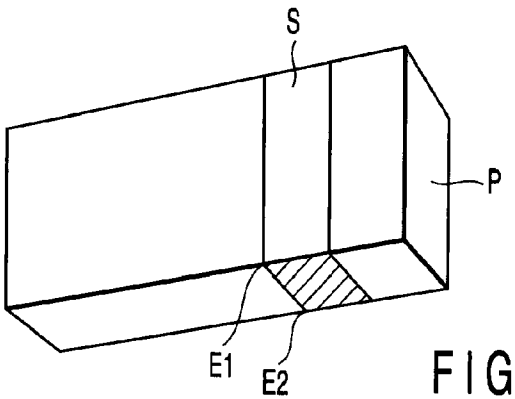
FIG. 11 is a view showing the state of a paper band wrapped around a bundle of banknotes.

FIG. 10 is a view showing one display example of the layout display portion 111. FIG. 11 is a view showing the state of a paper band wrapped around a preset number of banknotes (the state of a paper band used for sealing).

In an example shown in FIG. 10, a date information printing area R1, sequence information printing area R2, operator information printing area R3 and free information printing area R4 are displayed in different colors in the layout display portion 111. The colors of the respective areas R1, R2, R3 and R4 are colors displayed by the buttons 120A, 120B, 120C and 120D. In FIG. 10, the date information printing area R1, sequence information printing area R2, operator information printing area R3 and free information printing area R4 are respectively indicated by oblique lines from right to left, oblique lines from left to right, horizontal lines and vertical lines.

Thus, according to the display contents of the layout display portion 111, the forms in which date information, sequence information, operator information and free information which are used as plural types of information items to be printed on paper bands are printed on the paper bands can be visually recognized by intuition. As a result, it becomes possible to easily set printing contents to paper bands according to the user's request.

Further, in the example shown in FIG. 10, an area R24 in which the sequence information printing area R2 and free information printing area R4 overlap each other is displayed in a color (for example, red) different from the colors of the areas R1, R2, R3, R4. In FIG. 10, the area R24 in which the sequence information printing area R2 and free information printing area R4 overlap each other is indicated in black.

The date information, sequence information, operator information and free information used as plural types of information items to be printed on the paper bands are information items such as characters and symbols. Therefore, even if the printing areas overlap each other, printed information can be recognized to human eyes in many cases although it becomes difficult to recognize. That is, if the user permits information items to be printed in an overlapping form, it is possible to print different information items in an overlapping form.

According to the display contents of the layout display portion 111, information items to be printed in an overlapping form among the date information, sequence information, operator information and free information which are used as plural types of information items to be printed on paper bands can be visually recognized by intuition. As a result, if it is not desired to print a plurality of information items on a paper band in an overlapping form, it becomes easy to set a plurality of information items so as not to overlap one another without fail since a to-be-overlapped portion can be easily recognized. On the other hand, if the user desires to print a plurality of information items in an overlapping form, it becomes easy to print desired information items in an overlapping form since a to-be-overlapped portion can be easily recognized. That is, various layouts can be easily set according to the user's request.

Further, in the example shown in FIG. 10, a plurality of bars E1 and a plurality of bars E2 indicating the edge positions of paper bands corresponding to plural bill types are displayed in the layout display portion 111. The bar E1 and bar E2 make one pair for each color. The bar E1 and bar E2 which make one pair for each color indicate the edge positions of a paper band for a bundle of banknotes for each bill type.

The edge positions of the paper band indicate positions corresponding to the edges of a bundle of banknotes when a paper band is wrapped around a preset number of banknotes (a bundle of banknotes). For example, when a preset number of banknotes are sealed as shown in FIG. 11, the paper band has the first edge position E1 and second edge position E2. In the display example shown in FIG. 10, the first edge position E1 shown in FIG. 11 corresponds to the bar E1 displayed in the upper stage and the second edge position E2 shown in FIG. 11 corresponds to the bar E2 displayed in the lower stage.

Therefore, if an area on the left side of the bar E1 is set as the surface of the bundle of banknotes in a state in which a paper band is wrapped around the bundle of banknotes, an area between the bar E1 and the bar E2 is set as the side surface of the bundle of banknotes and an area on the right side of the bar E2 is set as the back surface of the bundle of banknotes.

The bars E1, E2 are displayed in different colors for each bill type. As described above, when the sizes or thicknesses of banknotes are different for respective bill types, the edge positions of the paper band are different for respective bill types even if the number of banknotes is the same. Therefore, in the layout display portion 111, the edge positions of the paper bands are displayed in different colors for respective bill types.

For example, in the example shown in FIG. 10, as the bar E1, a gray bar E1 (gray), red bar E1 (red), blue bar E1 (blue), beige bar E1 (beige) and green bar E1 (green) are displayed. Further, as the bars E2 corresponding to the above bars E1, a gray bar E2 (gray), red bar E2 (red), blue bar E2 (blue), beige bar E2 (beige) and green bar E2 (green) are displayed.

In this case, the bar E1 (gray) and bar E2 (gray), bar E1 (red) and bar E2 (red), bar E1 (blue) and bar E2 (blue), bar E1 (beige) and bar E2 (beige), and bar E1 (green) and bar E2 (green) indicate edge positions of paper bands for respective bill types. For example, Euro banknotes use colors of gray, red, blue, beige and green for respective bill types. In this case, in the layout display portion 111, the bars E1 and E2 are displayed by use of colors of banknotes of the respective bill types. Thus, it becomes easy to visually recognize by intuition the edge positions corresponding to the bill types indicated by the bars E1 and E2.

By displaying the bars indicating the edge positions for each bill type, the paper band print setting operation for each bill type can be easily performed. Further, in the example shown in FIG. 10, all of the bars for each bill type are displayed. Therefore, even when the print setting operation which is common for all of the bill types is performed, the print setting operation can be performed while the edge positions of all of the bill types are being visually recognized.

As described above, in this embodiment, contents to be printed on a paper band are set while the layout of information to be printed on a paper band used to seal sheets for every preset number is displayed on the display portion. Thus, while contents to be printed on the paper band are visually recognized by intuition, print contents for the paper band which can be suitably set can be easily set without fail.

Further, information items of plural types to be printed on the paper bands are displayed by use of different colors. As a result, the position of the paper band on which information is printed can be easily visually recognized.

Further, an area in which information items of different types are printed in an overlapping form among plural types of information items to be printed on the paper band is displayed in a color different from the colors of the other areas. Thus, the area in which a plurality of information items are printed in an overlapping form can be easily visually recognized.

The edge positions of a bundle of a preset number of banknotes are displayed in different colors for respective bill types. Therefore, the operator can set the contents to be printed on the paper band while recognizing the edge positions of the bundle of banknotes of respective bill types.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A sheet processing apparatus which seals sheets for a preset number of sheets, the apparatus comprising:

a display section which displays an image of a paper band, a first edge position and a second edge position, the first edge position being indicative of an area which corresponds to a combination of a front surface and a side surface of a bundle of the sheets when a preset number of sheets are wrapped with the paper band, and the second edge position corresponding to the first edge position and being indicative of an area which corresponds to a combination of the side surface and a back surface of a bundle of the sheets when a preset number of sheets are wrapped with the paper band;

a setting section which sets printing contents to be printed on the paper band;

a display control section which displays the printing contents set by the setting section on the image of the paper band to be displayed by the display section;

a printing mechanism which prints the printing contents set by the setting section on a paper band used to seal the sheets;

a band supplying section which supplies the paper band on which the printing contents set by the setting section is printed by the printing mechanism to the sealing mechanism; and a sealing mechanism which wraps the paper band around sheets for every preset number of sheets and seals the sheets.

2. The sheet processing apparatus according to claim 1, wherein the setting section sets a printing position of information on the paper band, and the display section displays an image indicating a printing area of information on the paper band based on the printing position set by the setting section.

3. The sheet processing apparatus according to claim 1, wherein the setting section sets printing positions of plural types of information items to be printed on the paper band, and the display section displays printing areas of various information items on the paper band based on the printing positions for various information items set by the setting section in different colors.

4. The sheet processing apparatus according to claim 1, wherein the setting section sets printing positions of plural types of information items to be printed on the paper band, and the display section displays an area in which printing areas are overlapped among printing areas of various information items on the paper band based on the printing positions for various information items set by the setting section in a color different from colors of the other areas.

5. The sheet processing apparatus according to claim 1, wherein the display section displays the first edge positions and second edge positions for every type of sheet in colors corresponding to the types of sheets.

6. The sheet processing apparatus according to claim 1, further comprising a storage specifying button which specifies storage of setting contents set by the setting section, and a storage section which stores setting contents displayed by the display section as setting information when the storage specifying button is specified.

7. The sheet processing apparatus according to claim 6, further comprising a setting name specifying button which specifies a setting name to store setting contents set by the setting section, wherein the storage section stores the setting contents set by the setting section by use of a setting name specified by the setting name specifying button.

8. The sheet processing apparatus according to claim 1, further comprising an authentication section which authenticates whether an operator is a manager, wherein the setting section performs a setting process only by an operation by the manager authenticated by the authentication section.

* * * * *